United States Patent [19]

Young

[11] 3,994,665

[45] Nov. 30, 1976

[54] RECIRCULATING BURNER

[75] Inventor: Henry J. Young, Marblehead, Mass.

[73] Assignee: Consolidated Natural Gas Service Co., Inc., Pittsburgh, Pa.

[22] Filed: Sept. 12, 1975

[21] Appl. No.: 612,670

[52] U.S. Cl. ..... 431/116; 431/9; 431/11; 431/215

[51] Int. Cl.[2] ..... F23L 7/00

[58] Field of Search ..... 431/115, 116, 9, 215, 431/11; 432/21

[56] References Cited

UNITED STATES PATENTS

| | | | |
|---|---|---|---|
| 1,839,512 | 1/1932 | Waterman | 431/115 |
| 2,216,178 | 10/1940 | Astradsson | 431/11 |
| 3,620,657 | 11/1971 | Robinson | 431/9 |
| 3,652,194 | 3/1972 | Bailey | 431/9 |
| 3,705,784 | 12/1972 | Reichhelm | 431/116 |

*Primary Examiner*—Edward G. Favors

[57] ABSTRACT

A recirculating burner for burning a vaporizable liquid fuel comprising a housing, a combustion chamber in the housing, with inlet and outlet, a vaporizing chamber, with inlet and outlet, an air inlet for directing air under pressure into the combustion chamber, a fuel inlet atomizer, adjacent to the vaporizing chamber inlet, for automizing vaporizable liquid fuel and directing the fuel into the vaporizing chamber, a gaseous fuel inlet for feeding gaseous fuel into the combustion chamber, a first passage interconnecting the combustion chamber toward the combustion chamber outlet with the vaporizing chamber inlet, for receiving hot combustion gases from the combustion chamber, a second passage effectively interconnecting the vaporizing chamber outlet with the combustion chamber inlet, the air inlet communicating with the second passage, and a vortex generator at the interface of the fuel inlet atomizer, the first passage, and the vaporizing chamber inlet, the generator being rotatable with respect to the housing between two positions, a first open position in which the generator receives hot gases from the first passage and swirls them into a vortex, into which the fuel atomizer directs atomized fuel, for vaporization of the fuel by the gases in the generator and vaporizing chamber, and the first passage, generator, vaporizing chamber, and second passage together define a recirculation path for hot combustion gases from the combustion chamber, and a second closed position in which the generator blocks the recirculation path, and the gaseous fuel inlet feeds gaseous fuel into the combustion chamber for burning therein.

6 Claims, 5 Drawing Figures

FIG 1
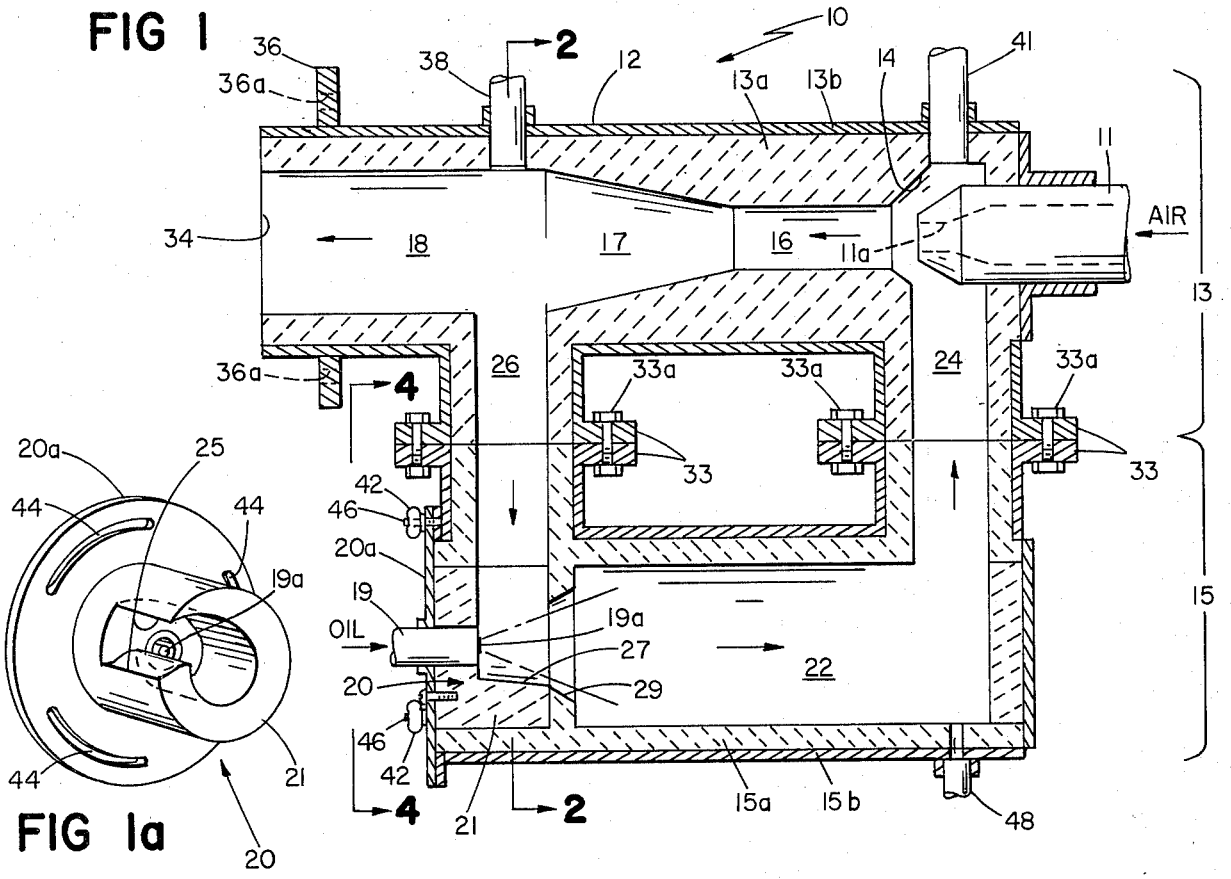
FIG 1a
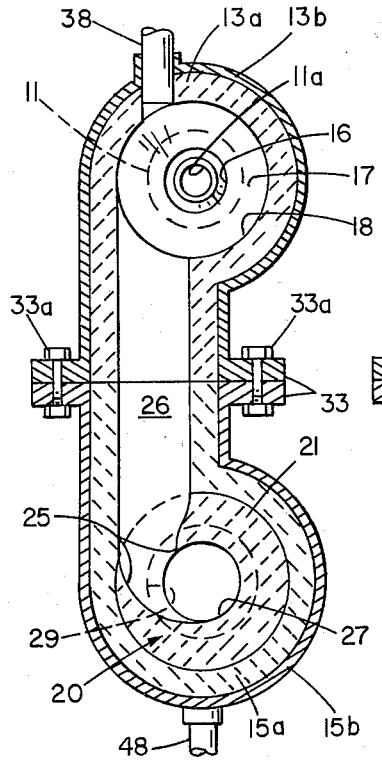
FIG 2
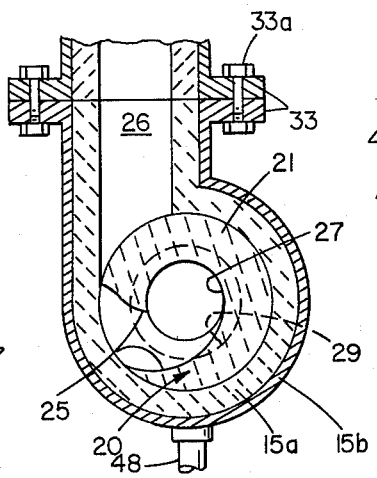
FIG 3
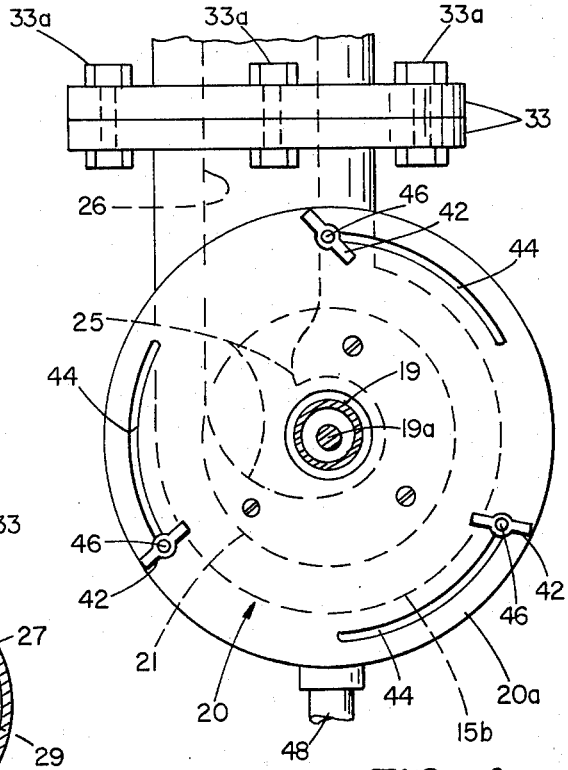
FIG 4

RECIRCULATING BURNER

BACKGROUND OF THE INVENTION

This invention relates to recirculating liquid fuel burners, and provides an improvement in certain respects in the burner claimed in the U.S. patent application of Andrew J. Syska, entitled "Recirculating Burner" and filed Sept. 4, 1975, Ser. No. 610,250.

Recirculation of hot combustion gases is a known means of vaporizing liquid fuel for better combustion thereof, but such recirculation is unnecessary and may be detrimental when the fuel is already a gas, such as natural gas. It is desirable to provide a simple means of converting a burner from a recirculating mode for burning a liquid fuel to a non-recirculating mode for burning a gaseous fuel. Andrew J. Syska, in his abovementioned patent application, suggested the use of sliding gates alternately to open or close the recirculation passages interconnecting the section of his burner where vaporization of liquid fuel occurs from the section where combustion occurs, thereby to permit or block recirculation.

SUMMARY OF THE INVENTION

The invention provides a safe, clean, simple, compact, easy-to-manufacture, convenient-to-use, and versatile recirculating liquid fuel burner capable of producing blue-flame, smoke-free, and quiet combustion.

The invention provides a burner capable of burning liquid or gaseous fuels. Switching from one type of fuel to the other is simple and quick to accomplish, without the need for a lot of complex adaptor equipment. The burner has a turndown range up to 4.5:1, and is capable of maintaining blue-flame combustion throughout the range. Vaporization of liquid fuel is complete, unwanted condensation of such fuel along the burner walls is prevented, and combustion is thereby made more efficient. Start-up is efficient, without waste of oil, and does not require complex or cumbersome starting equipment. High flame temperatures can be achieved for a variety of industrial applications such as forging and glass melting.

The invention features a recirculating burner for burning a vaporizable liquid fuel comprising a housing, a combustion chamber in the housing, the combustion chamber having an inlet and an outlet, a vaporizing chamber in the housing, the vaporizing chamber having an inlet and an outlet, an air inlet in the housing for directing air under pressure into the combustion chamber, a fuel inlet atomizer in the housing, adjacent to the vaporizing chamber inlet, for atomizing vaporizable liquid fuel from a source of the same and directing the fuel into the vaporizing chamber, a gaseous fuel inlet in the housing for feeding gaseous fuel from a source of the same into the combustion chamber, a first passage interconnecting the combustion chamber toward the combustion chamber outlet with the vaporizing chamber inlet, the first passage being arranged to receive hot combustion gases from the combustion chamber, a second passage effectively interconnecting the vaporizing chamber outlet with the combustion chamber inlet, the air inlet communicating with the second passage, and a vortex generator in the housing at the interface of the fuel inlet atomizer, the first passage, and the vaporizing chamber inlet, the vortex generator being rotatable with respect to the housing between two positions, a first open position in which the vortex generator receives hot gases from the first passage and swirls them into a vortex, into which the fuel inlet atomizer directs atomized liquid fuel, for vaporization of the fuel by the gases in the vortex generator and vaporizing chamber, and the first passage, generator, vaporizing chamber, and second passage together define a recirculation path for hot combustion gases from the combustion chamber to the vaporizing chamber and back to the combustion chamber, where vaporized fuel is burned with air from the air inlet, and a second closed position in which the vortex generator blocks gas flow from the first passage to the vaporizing chamber, thereby blocking the recirculation path, and the gaseous fuel inlet feeds gaseous fuel into the combustion chamber for burning therein with air from the air inlet.

In a preferred embodiment the vortex generator has a cylindrical body and the fuel inlet atomizer includes a nozzle, the body containing a throat and a generally tubular vortex chamber extending axially within the body, the body being rotatable about its axis between the two positions, the fuel inlet atomizer is connected to one end of the vortex chamber, the vaporizing chamber inlet is connected to the other end of the vortex chamber, the throat is directed into the vortex chamber tangentially of the chamber, and in the first open position, the throat interconnects the first passage and the vortex chamber along the wall of the vortex chamber between the ends of the chamber, and the nozzle produces a generally conical spray of atomized liquid fuel, whereby in the first open position hot combustion gases are accelerated through the throat to form the vortex in the vortex chamber, and the vortex swirls about the conical spray of fuel, providing vaporization thereof before the fuel can hit a wall, and in the second closed position the body blocks flow of hot combustion gases from the first passage to the vaporizing chamber; the vortex generator includes an end plate connected to the end of the body at which the fuel inlet atomizer is connected, for common rotation with the body, the end plate and the body each have an opening permitting the fuel inlet atomizer to pass therethrough into the vortex chamber, the end plate has a plurality of arcuate slots therein, the housing carries a plurality of fasteners for fastening the end plate to the housing through the slots, the fasteners and slots cooperating to provide adjustability, whereby the end plate may be selectively rotated with respect to the housing, thereby to rotate the body between the first and second positions; the vortex chamber is frustoconical, the widest portion of the chamber being at the end of the chamber connected to the vaporizing chamber inlet; and the gaseous fuel inlet enters the housing tangentially to the air inlet.

Other advantages and features of the invention will be apparent from the description and drawings herein of a preferred embodiment thereof.

BRIEF DESCRIPTION OF THE DRAWINGS

FIG. 1 is a side view, in cross section, of one embodiment of the invention;

FIG. 1*a* is an enlarged isometric view of the vortex generator used in the embodiment of FIG. 1;

FIG. 2 is a view through 2—2 of FIG. 1;

FIG. 3 is a view of a portion of the embodiment of FIG. 2, with the vortex generator blocking recirculation; and FIG. 4 is an enlarged view through 4—4 of FIG. 1.

DESCRIPTION OF THE PREFERRED EMBODIMENT

FIG. 1 shows burner 10, comprising housing 12, air inlet 11, suction chamber 14, cylindrical mixing chamber 16, frustoconical diffuser 17, cylindrical combustion chamber 18, oil inlet nozzle 19, vortex generator 20, cylindrical vaporizing chamber 22, and cylindrical passages 24 and 26, passage 24 interconnecting vaporizing chamber 22 with air inlet 11 and suction chamber 14, and passage 26 interconnecting combustion chamber 18 with vortex generator 20 and vaporizing chamber 22. Passages 24 and 26, vortex generator 20, and vaporizing chamber 22 together provide a recirculation path, as will be explained in more detail below.

Housing 12 comprises burner section 13 and recirculation section 15, the sections being composed, respectively, of inner refractories 13*a* and 15*a*, of 3000° F. heat-resistant concrete, and outer metal piping 13*b* and 15*b*. Sections 13 and 15 are held together by bolts 33*a* between upper and lower flanges 33, the two sections together completing passages 24 and 26. Burner 10 is mounted on a furnace, boiler or other heating receptacle by means of flange 36 surrounding and spaced inward from the combustion chamber outlet 34. Outlet 34 is inserted into a hole in the furnace wall (not shown), and flange 36 bolted to the furnace wall through flange holes 36*a*. Tube 38 permits a pilot light to communicate with combustion chamber 18 at burner start-up. Section 15 can be demounted from section 13 by removal of bolts 33*a* from flanges 33, if prolonged use of gas fuel is desired, making section 15 unnecessary.

Passage 26 (2 inches in diameter), connected to combustion chamber 18 (inner diameter 3½ inches), carries hot, burned gases from chamber 18 to vortex generator 20. Vortex generator 20 (FIG. 1*a*) comprises cylindrical refractory body 21 connected to end plate 20*a* and containing constricted throat 25 and frustoconical vortex chamber 27. Throat 25 extends from passage 26, and is connected to chamber 27 transversely to the chamber axis, the lower portion of throat 25 being curved to intersect chamber 27 tangentially thereto (FIG. 2). Separate frustoconical chamber guide 29 is fixed in section 15 between vortex generator 20 and vaporizing chamber 22, is flared more than chamber 27, and has an imaginary vertex angle of 50°. Oil inlet nozzle 19 carries liquid fuel from an oil source through openings in end plate 20*a* and body 21 into vortex chamber 27. Nozzle pin 19*a* atomizes the liquid fuel into a fine spray in the form of a cone having a 50° vertex angle projecting into chamber 27. Hot gases from combustion chamber 18 coming through passage 26 and throat 25 are accelerated and swirl tangentially into a vortex about the oil spray cone in chamber 27. The term "vortex" as used throughout this application, when referring to gases, means not simply a swirling motion of the gases but a tangential acceleration of the gases to provide an accelerated swirling motion. Vortex generator 20 can be removed as a unit from burner 10 by removal of end plate 20*a*, plate 20*a* being secured to piping 15*b* along flanged portions of both by wing nuts 42 secured to studs 46 protruding from the flanged portion of piping 15*b*. The structure and operation of vortex generator 20 to cut off recirculation when gaseous fuel is used will be described below. Should condensation of fuel occur, drainage nipple 48, positioned near the vaporizing chamber outlet, will remove such fuel.

Air inlet 11, upon entering suction chamber 14, terminates with nozzle 11*a*. Air under pressure enters suction chamber 14 through nozzle 11*a*. This jet of incoming air creates in passage 24 a suction, which draws the gaseous contents of vaporizing chamber 22 (4 inches in diameter) through passage 24 (2 inches in diameter) into suction chamber 14. Inlet 11 can be removed from burner 10 by removal of end plate 40.

Operation in the start-up and full-running modes will now be described. In start-up, air under pressure is admitted into burner 10 through inlet 11. A pilot light is permitted to communicate with combustion chamber 18 through tube 38. The air passes through suction chamber 14, mixing chamber 16, diffuser 17, and combustion chamber 18. A portion of the air is drawn into passage 26 by the suction created by nozzle 11*a* and then into vortex generator 20. In generator 20, the air first enters throat 25 where it is accelerated by the constricted throat design, and passes into vortex chamber 27. Oil is then admitted in atomized form through nozzle 19 and nozzle pin 19*a* into chamber 27 as a fine spray in a 50° cone, pin 19*a* determining the cone angle. The air from throat 25 enters chamber 27 transversely to the direction of the oil spray and tangentially to the spray cone. The air swirls through chamber 27 in the form of a vortex, and carries the oil mist out through chamber guide 29 into vaporizing chamber 22. The swirling air assists in vaporizing the oil. Suction created by nozzle 11*a* in passage 24 draws the air-oil mixture through vaporizing chamber 22, up through passage 24, into the flow of air from nozzle 11*a* in suction chamber 14, through mixing chamber 16, where further mixing occurs, into diffuser 17, where velocity head is converted into pressure head, and into combustion chamber 18, where the mixture is ignited by the pilot light in tube 38. The pilot light is shut off after ignition. Combustion occurs in chamber 18, diffuser 17 providing flame stabilization.

In full operation, part of the gaseous products of combustion leaves burner 10 through outlet 34, but part is drawn into passage 26 by the suction created by nozzle 11*a*. These hot combustion gases enter vortex generator 20, passing through throat 25, where they are accelerated into vortex chamber 27. The hot gases whirl in the form of a vortex around the cone of oil mist, as did the recirculating air in start-up, and vaporize the oil, preventing the oil from condensing on the walls of vortex chamber 27 or vaporizing chamber 22. This hot gas-oil vortex passes out of chamber 27 through guide 29 into vaporizing chamber 22, where vaporization of the oil by the hot gases continues. Chamber 22 is kept below the temperature required to crack the hydrocarbon fuel (usually 900° F.), because the heat required to vaporize the liquid fuel comes from the hot gases, leaving them cooler, though chamber 22 stays above the fuel vaporization temperature (usually 600° F.). Suction created by nozzle 11*a* draws the hot gas-vaporized oil mixture from chamber 22 through passage 24 and suction chamber 14 into mixing chamber 16, where the mixture is further mixed with the jet of incoming air. The hot gas-oil-air mixture then passes through diffuser 17 to be burned in chamber 18. Combustion occurs with a blue flame, and is quiet and smoke-free. Fuel consumption is variable, with a turndown range (the ratio of maximum fuel rate in gph to minimum fuel rate in gph) of 4.5:1 and blue flame operation throughout. One simply adjusts the amount of spray through nozzle 19 and air through inlet 11 to obtain the desired rate of consumption within the permitted range. Fuel and air inputs can be stoichiometric, though excess air can vary up to at least 200 percent.

In full operation as above described, passages 24 and 26, vortex generator 20 and vaporizing chamber 22 are all wide enough to provide, in conjunction with air inlet 11 (which, with suction chamber 14, mixing chamber 16, and diffuser 17, acts as a jet pump), a percent recirculation sufficient to maintain blue-flame combustion, which, with no excess input air, would be at least 50 percent under standard conditions, i.e., 1 atmosphere of pressure and 70° F., where percent recirculation, R, is defined as follows:

$$R = \frac{\text{standard cfm of recirculated combustion products}}{\text{standard cfm of stoichiometric input air}} \times 100.$$

The inner width of these parts, which together define the recirculation path, is large enough to lower the pressure drop caused by nozzle 11*a* and sustain this large amount of recirculation flow.

When the desired fuel is a gas, such as natural gas, recirculation is unnecessary, since the fuel does not need to be vaporized. Vortex generator 20 is rotatable, with respect to recirculation section 15, about the axis of vortex chamber 27. The three wing nuts 42 connect end plate 20*a* to piping 15*b* by being threaded onto studs 46 protruding through arcuate slots 44 (FIG. 4) in end plate 20*a* from the flanged end portion of piping 15*b*. In FIGS. 1, 2, and 4 vortex generator 20 is shown in the open position, permitting recirculation of hot combustion gases as above described. In this open position each wing nut 42 is tightened onto its respective stud 46 at one end of each slot 44 (FIG. 4). When wing nuts 42 are loosened, end plate 20*a* is rotated counterclockwise to bring the opposite end of each slot 44 against its respective stud 46, thereby rotating throat 25 wholly out of alignment with passage 26, interposing body 21 into the path of passage 26, blocking flow through this passage, for use of the burner in the gas mode (FIG. 3). Nuts 42 are tightened to maintain this blocking position. Gaseous fuel is then admitted through inlet 41 into suction chamber 14 tangentially to air entering through nozzle 11*a*. For prolonged use in the gas mode, recirculation section 15 can be demounted and removed from burner 10. In that case, the upper halves of passages 24 and 26 are blocked by covers bolted to upper flanges 33.

Modifications include a vertex angle from 30° to 50° for the oil spray cone.

Vaporizing the fuel in a separate vaporizing chamber by the heat of recirculating hot gases before the atomized fuel reaches a wall was the invention of Alex F. Wormser. Spraying atomized liquid fuel in the same general direction as the flow of recirculating hot gases and into that flow, and use of a vortex generator between the combustion chamber and the vaporizing chamber for swirling hot combustion gases into a vortex into which atomized liquid fuel is introduced, for vaporization of the fuel, were the invention of Andrew J. Syska. The contents of the Wormser application, filed Aug. 22, 1975, Ser. No. 606,841, and the Syska application, filed Sept. 4, 1975, Ser. No. 610,250, both in the United States and both entitled "Recirculating Burner", are hereby incorporated herein by reference.

Other embodiments are within the following claims.

What is claimed is:

1. A recirculating burner for burning a vaporizable liquid fuel comprising:

a housing, a combustion chamber in said housing, said combustion chamber having an inlet and an outlet, a vaporizing chamber in said housing, said vaporizing chamber having an inlet and an outlet, an air inlet in said housing for directing air under pressure into said combustion chamber, a fuel inlet atomizer in said housing, adjacent to said vaporizing chamber inlet, for atomizing vaporizable liquid fuel from a source of the same and directing said fuel into said vaporizing chamber, a gaseous fuel inlet in said housing for feeding gaseous fuel from a source of the same into said combustion chamber, a first passage interconnecting said combustion chamber toward said combustion chamber outlet with said vaporizing chamber inlet, said first passage being arranged to receive hot combustion gases from said combustion chamber, a second passage effectively interconnecting said vaporizing chamber outlet with said combustion chamber inlet, said air inlet communicating with said second passage, and a vortex generator in said housing at the interface of said fuel inlet atomizer, said first passage, and said vaporizing chamber inlet, said vortex generator being rotatable with respect to said housing between two positions, a first open position in which said vortex generator receives hot combustion gases from said first passage and swirls them into a vortex, into which vortex said fuel inlet atomizer is adapted to direct atomized liquid fuel, for vaporization of said fuel by said hot gases in said vortex generator and vaporizing chamber, and said first passage, said vortex generator, said vaporizing chamber, and said second passage together define a recirculation path for hot combustion gases from said combustion chamber to said vaporizing chamber and back to said combustion chamber, where vaporized fuel is burned with air from said air inlet, and a second closed position in which said vortex generator blocks the flow of hot combustion gases from said first passage to said vaporizing chamber, thereby blocking said recirculation path, and said gaseous fuel inlet feeds gaseous fuel into said combustion chamber for burning therein with air from said air inlet.

2. The burner of claim 1 wherein said vortex generator has a cylindrical body and said fuel inlet atomizer includes a nozzle, said body contains a throat and a generally tubular vortex chamber extending axially within said body, said body being rotatable about its axis between said two positions, said fuel inlet atomizer is connected to one end of said vortex chamber, said vaporizing chamber inlet is connected to the other end of said vortex chamber, said throat is directed into said vortex chamber tangentially of said chamber, and in said first open position, said throat interconnects said first passage and said vortex chamber along the wall of said vortex chamber between the ends of said chamber, and said nozzle produces a generally conical spray of atomized liquid fuel, whereby in said first open position said hot combustion gases are accelerated through said throat to form said vortex in said vortex chamber, and said vortex swirls about said conical spray of fuel, providing vaporization thereof before said fuel can hit a wall, and in said second closed position, said body blocks flow of said hot combustion gases from said first passage to said vaporizing chamber.

3. The burner of claim 2 wherein said vortex generator includes an end plate connected to the end of said body at which said fuel inlet atomizer is connected, for common rotation with said body, said end plate and said body each have an opening permitting said fuel inlet atomizer to pass therethrough into said vortex chamber, said end plate has a plurality of arcuate slots therein, said housing carries a plurality of fasteners for fastening said end plate to said housing through said slots, said fasteners and said slots cooperating to provide adjustability, whereby said end plate may be selectively rotated with respect to said housing, thereby to rotate said body between said first and second positions.

4. The burner of claim 3 wherein said vortex chamber is frustoconical, the widest portion of said chamber being at the end of said chamber connected to said vaporizing chamber inlet.

5. The burner of claim 2 wherein said gaseous fuel inlet enters said housing tangentially to said air inlet.

6. A recirculating liquid fuel burner which comprises:

a combustion chamber, a vaporization chamber, a first passage connecting a downstream portion of said combustion chamber with said vaporization chamber, a second passage connecting a downstream portion of said vaporization chamber with an upstream portion of said combustion chamber, fuel delivery means to discharge fuel at the junction of said first passage and said vaporization chamber, air delivery suction means to cause recirculation from said combustion chamber through said first passage, said vaporization chamber, and said second passage, and a vortex generator rotatably mounted at the junction of said first passage and said vaporization chamber, whereby said vortex generator may be selectively rotated between an open and a closed position.

* * * * *